US006038969A

United States Patent [19]

Podlipec et al.

[11] Patent Number: 6,038,969

[45] Date of Patent: Mar. 21, 2000

[54] TENSIONING FRAME

[75] Inventors: Milan Podlipec; Bostjan Podlipec, both of Vrhnika; Janez Zepic, Ljubljana; Kilijan Vizjak, Kranj, all of Slovenia

[73] Assignee: LPKF d.o.o., Zgornje Jezersk, Slovenia

[21] Appl. No.: 09/188,262

[22] Filed: Nov. 10, 1998

[30] Foreign Application Priority Data

Nov. 10, 1997 [DE] Germany ..... 197 49 449

[51] Int. Cl.[7] ..... B05C 17/08

[52] U.S. Cl. ..... 101/127.1; 101/127

[58] Field of Search ..... 101/126, 127, 101/127.1, 128, 128.1, 128.21

[56] References Cited

U.S. PATENT DOCUMENTS

| | | | |
|---|---|---|---|
| 3,176,843 | 4/1965 | Hoskins et al. | 101/127.1 |
| 4,442,772 | 4/1984 | Bubley | 101/127.1 |
| 4,571,864 | 2/1986 | Bopp | 101/127.1 |
| 5,347,925 | 9/1994 | Holderegger | 101/127 |
| 5,819,651 | 10/1998 | Zepic et al. | 101/127.1 |

*Primary Examiner*—John Hilten
*Assistant Examiner*—Amanda B. Sandusky
*Attorney, Agent, or Firm*—Evenson, McKeown, Edwards & Lenahan, P.L.L.C.

[57] ABSTRACT

A tensioning frame (1) for stencils (9) formed of metal foils or plastic films, especially for stencil printing, provided at their margins (8) with perforations (10) for tensioning. The frame includes a tensioning device operated by a pressure medium for driving tensioning bars (5) that carry hooking pins (6) that engage the perforations of the stencil. The tensioning device is formed by an elastically deformable tensioning tube (4) disposed in a frame profile (2) and uniformly supplied with a pressure medium. The tensioning bars lie with the full length of their front sides in contact with the tensioning tube and with their back sides resting against fulcrum nubs (17) which in turn are supported against an extrusion (3) which closes the frame profile. The tensioning bars can be pivoted by inflating and expanding the tensioning tubes to stretch the stencil over a bridge (16) on the frame.

20 Claims, 5 Drawing Sheets

TENSIONING FRAME

BACKGROUND OF THE INVENTION

The invention relates to a tensioning frame for tensioning stencils of metal foil or plastic film provided with perforations at their margin, especially for stencil printing, wherein a clamping device is disposed in the frame and operated by a pressure medium for displacing tensioning bars having hooking pins which enter the perforations in the stencil.

Tensioning frames of this kind have been disclosed in published German Patent Application No. DE 195 30 373 A1. There, however, it is disadvantageous that on each tensioning bar two tensioning cylinders operated by compressed air are disposed at a great distance apart. It has been found that when the stencil is stretched, the result is a flexing of the tensioning bar. The resulting distortions have an adverse effect, since the requirements for accuracy in the mounting of the stencil are very high, especially in the case of "on-contact" printing in the fine pitch range.

Published PCT Application No. WO 92/08616 discloses a tensioning frame in which a tensioning beam is displaced by means of a tube supplied with a pressure fluid to tension a stencil. A holding band is fastened to the tension beam and bears the hooking pins for gripping the stencil. This, however, has the particular disadvantage that the means for guiding the tension beam must be very complicated.

Published PCT Application No. WO 97/03833 discloses the operation of the tensioning means of a tensioning frame by pressurized tensioning tubes. Here, however, the functionality requires the arrangement of an additional spring system.

SUMMARY OF THE INVENTION

It is the object of the invention to provide a tensioning frame which is characterized by simple and inexpensive construction plus a high tensioning force that can be applied uniformly to the entire working surface of the stencil.

This and other objects of the invention have been achieved in accordance with the present invention by providing a tensioning frame for a metal foil or synthetic resin film having mounting perforations adjacent its margin, the tensioning frame comprising a frame member having a plurality of sides; at least one tensioning bar extending along a respective side of the frame member, each tensioning bar being pivotably mounted in its respective side of the frame member and carrying a plurality of holding pins which engage in mounting perforations of a foil or film to be tensioned; an elastically deformable inflatable tensioning tube disposed alongside each tensioning bar adjacent an inward side thereof relative to the frame member, and a pressure fluid source in fluid communication with each tensioning tube; each the tensioning tube being inflatable by the pressure fluid source to expand the tensioning tube against the adjacent tensioning bar and pivot the tensioning bar in an outward direction relative to the frame member, whereby a foil or film having its mounting perforations engaged on the holding pins of the tensioning bar will be tensioned.

In accordance with the invention, a tensioning device for displaceable tensioning bars is provided in the tensioning frame. The tensioning device is operated by means of a pressure fluid and includes hooking pins which engage perforations in a stencil. The tensioning device is disposed in an extruded outer frame member and is in the form of elastically deformable tensioning tubes which can be supplied uniformly with a pressure fluid and against which the front of the tensioning bars rests along their full length. The back of the tensioning bars is provided with fulcrum strips which bear against an extrusion inserted in the outer frame member, such that the tensioning bars can be rocked on the fulcrum strip by the tensioning tubes to tension the stencil.

The result of this configuration is a very precise operation of the tensioning bars throughout the tensioning action, with very simple means. The tensioning bars always pivot uniformly along their entire width, without lateral shifting. In addition, the tensioning tubes engage the tensioning bars along their entire length, so that the actuating force is applied to the tensioning bars very precisely over their full length. Thus, any deformation of the tensioning bars is effectively prevented. This means that the hooking pins in the tensioning bars remain precisely in their designated position during the tensioning action, so that the tensioning force is applied very uniformly to the delicate stencil. Any harmful distortion of the stencil that might impair its flatness is thus securely avoided. In sum, by means of the tensioning frame according to the invention, the stencil can be tensioned with the greatest precision. In particular, the result is the possibility of using it also in the field of "on-contact" printing even in fine pitch operations. Precision is enhanced by the possibility of tensioning the stencil uniformly on four sides.

According to one preferred embodiment of the invention, the fulcrum strips are arranged off-center on the back of the tensioning bars, extending substantially over their entire length, while the tensioning tubes for tightening the stencil are located substantially on-center on the front. Such an arrangement of the fulcrum strips provides extremely effective support for the tensioning bar along its full length. Furthermore, this arrangement results in a pronounced supporting leverage for the tensioning forces applied by the tensioning tubes.

Within the scope of the invention, the tensioning tubes can be connected together by connecting pieces fixed in the frame. It has been found that this arrangement makes it possible to precisely position the tensioning tubes and avoid harmful deformation.

In accordance with a preferred embodiment of the invention, the extruded outer frame is channel-shaped and contains an extrusion inserted within it in such a way that an internal free space is formed in which the connecting pieces are arranged as corner connectors along with the tensioning tubes and the tensioning bars.

Furthermore, the connecting pieces are provided with nipples for connecting the tensioning tubes and with passages for a pressure fluid, and one connecting piece is provided with an inlet leading to a pressure fluid source. It is thus possible to feed the fluid uniformly to the tensioning tubes in a very simple manner from a single pressure source.

It is advantageous if the connecting pieces are constructed in two parts and comprise a corner piece and an adjoining piece, the corner piece being provided with a nipple for connecting a tensioning tube and with a plug-in opening disposed at right angles to the nipple for a mounting stud on the connecting piece. The connecting piece furthermore has a nipple extending in the direction of the mounting stud for an additional tensioning tube. Such a configuration makes it possible to connect the tensioning tubes to the corresponding connecting pieces before they are inserted into the outer frame member of the tensioning frame. The tensioning tubes are then inserted together with the connecting pieces into the outer frame member. Then the connecting pieces are connected to one another by plugging the connecting nipples into the corresponding socket opening. As a result of this arrangement, the overall installation of the tensioning tubes is very simple. The clamping tubes are furthermore disposed in the free space in the outer frame member in an optimum manner, i.e., without any kinking, for example, in the corners of the frame, to interfere with their perfect operation.

In a preferred embodiment of the invention, the passages in the connecting pieces lead to the socket opening and into the mounting studs. In this manner a reliable connection is assured when the socket connection is made.

Within the scope of the invention, the tensioning bars are disposed in pairs in the outer frame member opposite one another near the margins of the stencil to be tensioned. Either two tensioning bars or even four tensioning bars can be arranged in pairs opposite one another in the outer frame member. According to a preferred embodiment of the invention, four tensioning bars are arranged opposite one another in pairs, so that the stencil can advantageously be tensioned on all four sides. The result is an especially good flattening of the stencil.

Preferably, the hooking pins in the tensioning bars extend out of the outer frame member and pass through holes in the margins of the stencils. The hooking pins are consequently able to grasp the stencils in the plane of the frame and tension them.

It is furthermore advantageous if adjusting screws are arranged near the tensioning bars to limit the movement of the tensioning bars. It is thus possible to adjust and to optimize the tension force acting on the stencil.

Provision is furthermore made for the portions of the hooking pins of the tensioning bars, which protrude from the tensioning frame, to have an approximately semicircular cross-sectional shape, flattened edges being aligned in the direction of the tension applied to the stencil, the stencil being provided along its margins with perforations which match the shape and arrangement of the hooking pins on the tensioning bars. Due to this arrangement, the tension forces applied to the stencil by the hooking pins are applied to it in an optimum manner.

Preferably, the flattened edges of the hooking pins are slanted so as to be perpendicular to the plane of the stencils and are undercut. The resultant advantage is that the stencils are very securely gripped as they are stretched and are then securely held.

It has furthermore proven to be advantageous if the stencil is provided on its margins with additional U-shaped notches which, when the stencil is fastened on the tensioning frame, will engage guiding pins disposed thereon in order to securely and rapidly position the stencil.

In another embodiment of the invention, cover plates, which extend over the hooking pins of the tensioning bar, can be fastened on the tensioning frame at the margins of the stencil. The cover plates are preferably provided with slots and can be fastened to the tensioning frame by pushing them on. Thus, projections of the slots of the cover plates enter under heads of the guiding pins of the tensioning frame. The cover plates press the perforations of the stencil securely onto the hooking pins and cover them over.

In accordance with a further preferred embodiment of the invention, each frame member of the tensioning frame is closed by an integral closing profile formed in one piece therewith on an outward side thereof relative to the frame member.

BRIEF DESCRIPTION OF THE DRAWINGS

The invention will be described in further detail hereinafter with reference to an illustrative preferred embodiment shown in the accompanying drawings, in which.

DETAILED DESCRIPTION OF PREFERRED EMBODIMENTS

Figure 1:
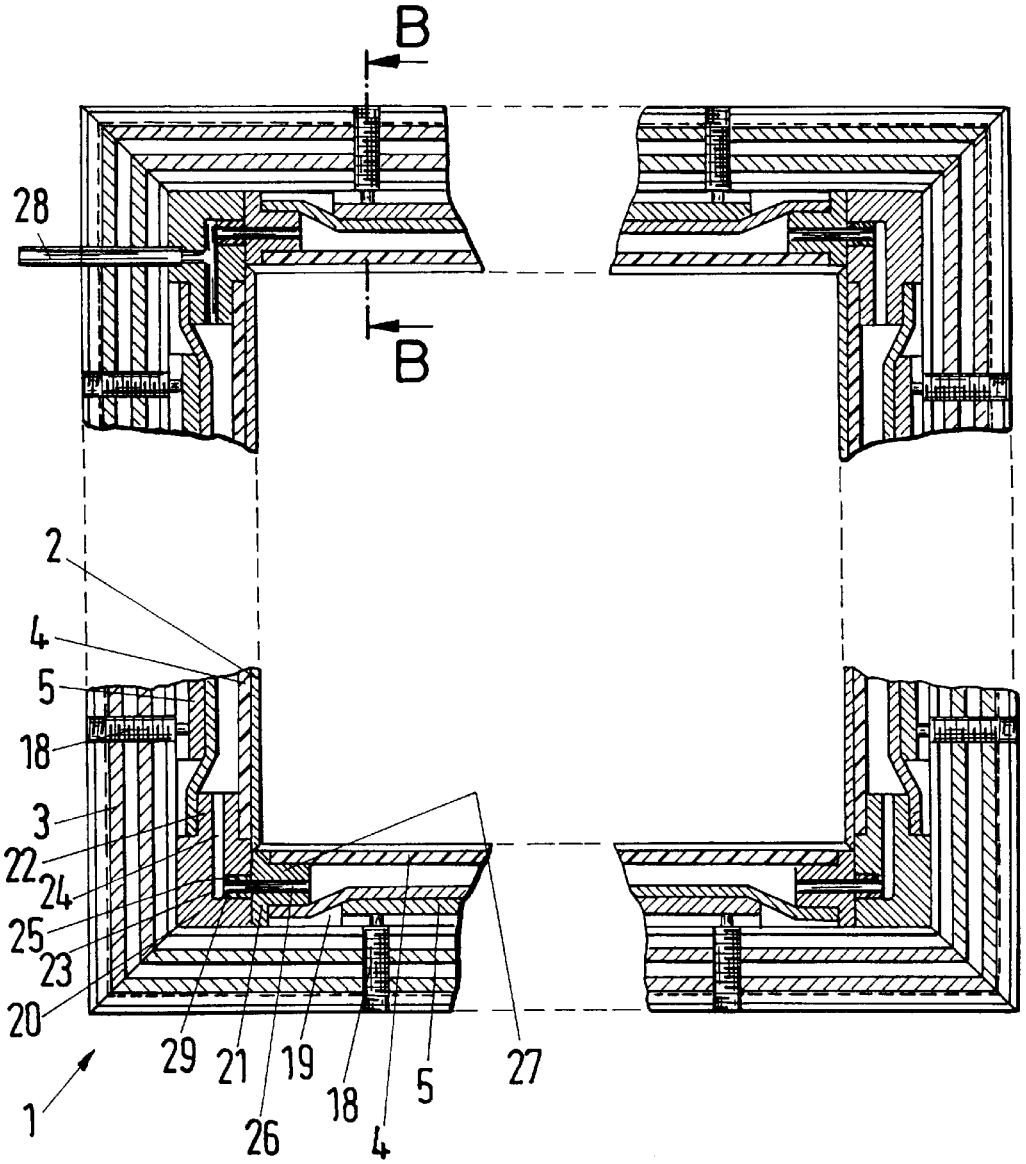
FIG. 1 shows a longitudinal section through a tensioning frame according to the invention taken along line A—A in FIG. 2.
Figure 2:
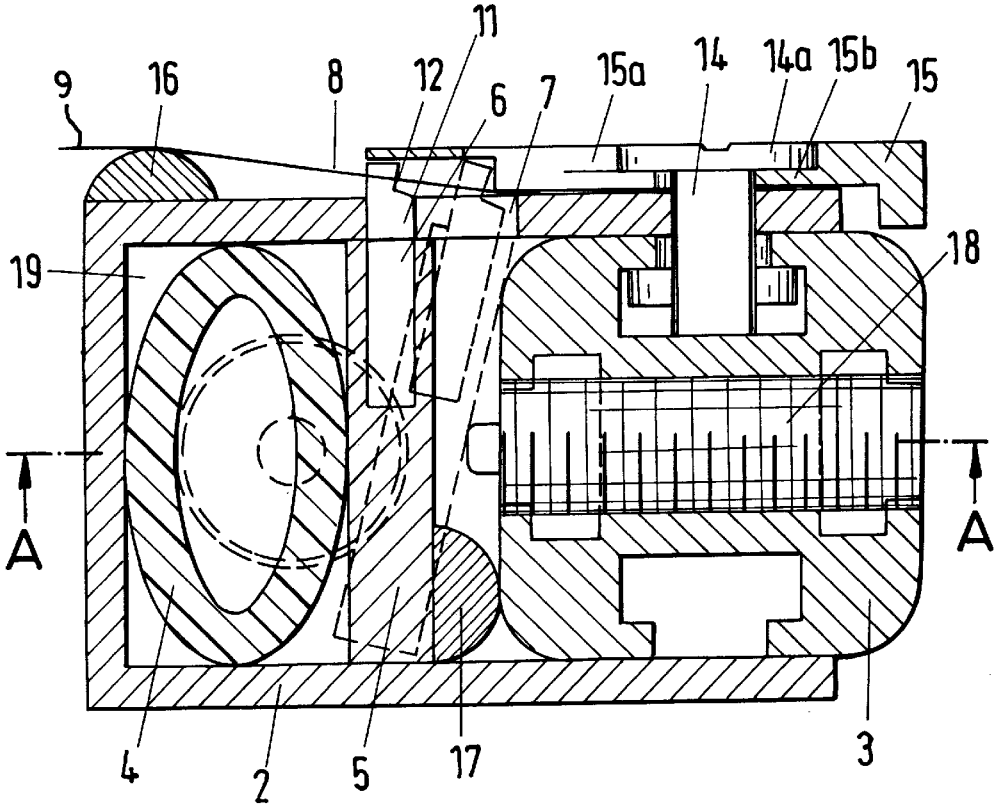
FIG. 2 shows a cross section taken through the tensioning frame of FIG. 1 along line B-B thereof, on an enlarged scale.

In the drawing, 1 identifies a tensioning frame, only the four corners of which are represented in FIG. 1 to save space. The tensioning frame 1 is formed by a channel-shaped frame member 2 which is closed with an extruded profile 3. A tensioning tube 4 and a tensioning bar 5 in contact with the tensioning tube 4 are disposed within the outer frame member. The tensioning bar 5 is provided on one longitudinal edge with hooking pins 6. As can be seen in FIG. 2, the hooking pins project out of the frame member 2 through openings 7 in the margins 8 of a stencil 9 that is to be stretched. The hooking pins 6 extend through perforations 10 in the stencil 9, which can be seen in FIG. 6.

Figure 4:
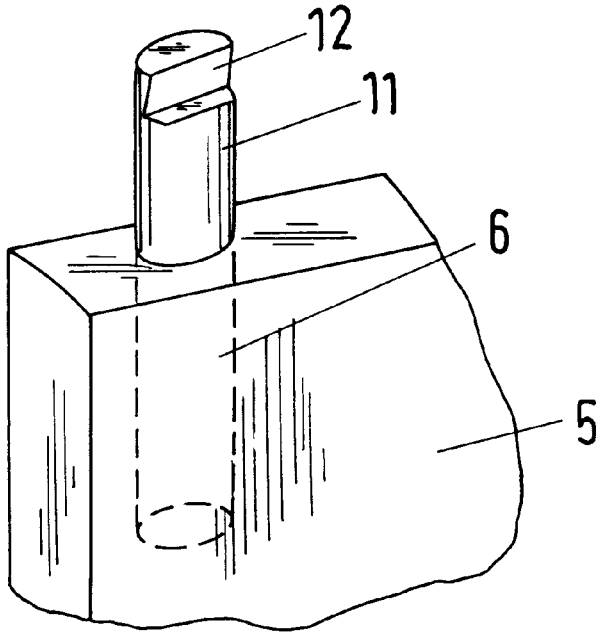
FIG. 4 shows an enlarged perspective drawing of one pin of a clamping bar.
Figure 5:
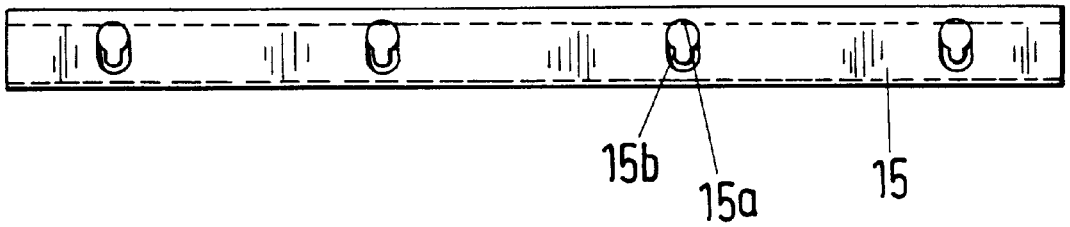
FIG. 5 shows a plan view of a cover strip of a tensioning bar.
Figure 6:
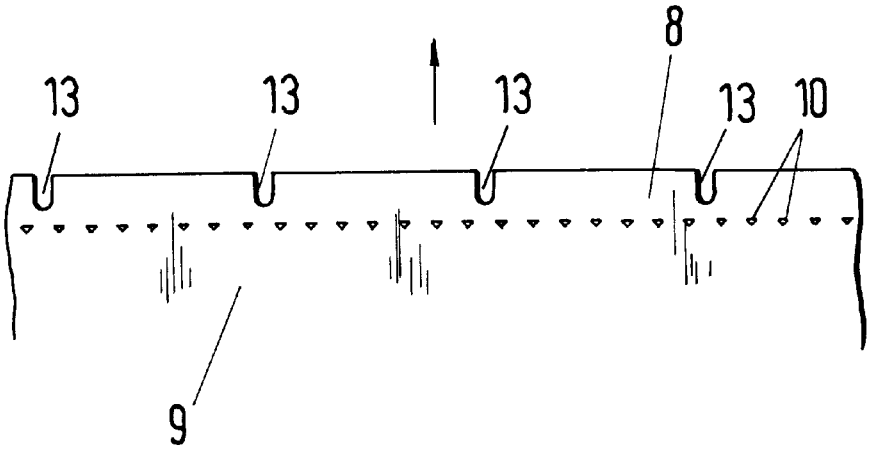
FIG. 6 shows a section of a margin of a stencil that can be stretched flat in the tensioning frame.

As can be seen especially in FIG. 4, the hooking pins 6 are somewhat semicircular in cross section at their section 11 which protrudes from the tensioning frame 1. Flattened edges 12 of section 11 are aligned in the direction of the tensioning of the stencil 9 which, as seen in FIG. 6, is provided with perforations 10 which are matched in shape and arrangement to the hooking pins 6 on the tensioning bars 5. The flattened edges 12 of the hooking pins 6 are furthermore slanted relative to the horizontal plane of the stencil 9 and are configured with an undercut. Due to this configuration, the stencil 9 is securely held by the hooking pins 6 of the tensioning bars 5. Also, by means of the flattened edges 12 of the hooking pins 6, the tension forces are applied to the stencil 9 in an optimum manner.

Additional guides in the form of U-shaped notches 13 are disposed at the margins 8 of the stencil 9. When stencil 9 is applied to the tensioning frame 1, these notches 13 in stencil 9 engage guide pins 14 in the tensioning frame for alignment. After the stencil 9 is fastened to the tensioning frame 1, it lies with its marginal area positioned on bridges 16 disposed around the tensioning frame 1.

Cover plates 15 are provided for the margins 8 of the stencil 9 and the hooking pins 6. The cover plates 15 have slots 15*a* with projections 15*b* and can be fastened to the tensioning frame by pushing them on. The projections 15*b* of the slots 15*a* of cover plates 15 thereby engage under heads 14*a* of the guide pins 14 of the tensioning frame 1, so that the cover plates 15 thus are securely held in a positive manner. The cover plates 15 press the perforations 10 of the stencil 9 securely onto the hooking pins 6 and cover the hooking pins. The cover plates 15 are disposed on the tensioning frame in the vicinity of the margins 8 of the stencil 9 and of the tensioning bars 5 with their hooking pins 6.

Figure 3:
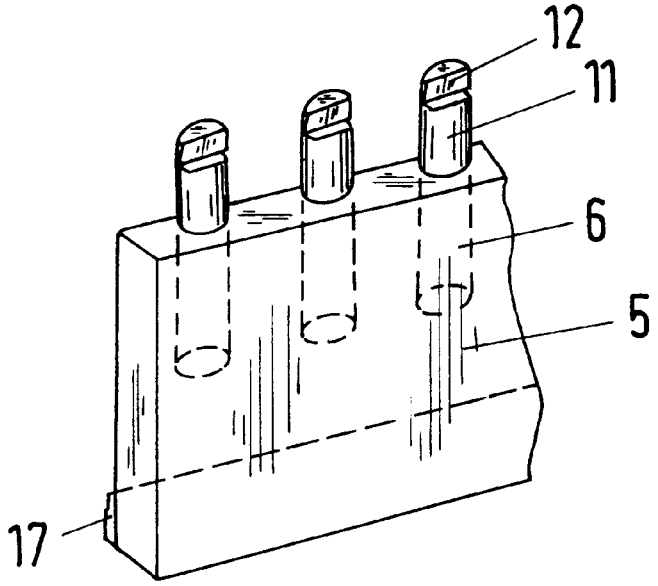
FIG. 3 shows a section of a clamping bar.

As can also be seen in FIG. 3, the tensioning bars 5 are provided with a fulcrum strip 17 extending over their entire length which is supported against the outer profile 3 of the frame 1. By supplying fluid under pressure to the tensioning tubes 4, the tensioning bars 5 can be rocked or pivoted against their fulcrum strips 17 to the position represented in broken lines in FIG. 2 so as to tension the stencil 9 fastened by its perforations on the hooking pins 6. In this position the stencil 9 is tensioned. The pivoting angle of the tensioning bars 5 can be adjusted by means of adjusting screws 18, which are displaceable in the outer profile 3. Thus, it is also possible to adapt the tensioning frame 1 to the arrangement of the perforations 10 of different stencils 9. As can be seen in FIG. 1, the adjusting screws are distributed around the outer sides of the tensioning frame 1.

Instead of a fulcrum strip 17 extending over the entire length, the tensioning bars 5 can be provided with individual fulcrum points distributed along the pivot line. An always very precise pivoting of the tensioning bars 5 is also assured in this case.

The tensioning tubes 4 disposed in an open space 19 in the frame member 2 are connected to one another by couplings fixed in the frame 1, which are formed by a corner piece 20 and a connecting piece 21. Each corner piece 20 is provided with a nipple 22 for one of the tensioning tubes 4 and with a socket opening 23. The nipple 22 and the socket opening 23 are connected to one another by a passage 24 for carrying the pressure fluid.

The connecting piece 21 is provided with a mounting pin 25 which can be received in the socket opening 23 of the corner piece 20 when the couplings are assembled. The mounting pin 25 is connected by a passage 26 carrying the pressure fluid to a nipple 27 on the connecting piece 21. By means of the nipple 27 the connecting piece 21 can be connected to one of the tensioning tubes 4. One corner piece 20 of the tensioning frame 1 is additionally provided with a connection 28 through which the passages 24 and 26, as well as the tensioning tubes 4, can be connected to a pressure source, not shown in the drawing. The mounting pin 25 is provided on its circumference with two sealing rings 29 which seal the connection.

Instead of compressed air, a different pressure fluid, such as a liquid, for example, can be introduced into the tensioning device. It is basically possible to clamp all four sides of a stencil simultaneously and uniformly in the tensioning frame 1 by the uniform action of a pressure fluid, preferably compressed air, on all of the tensioning tubes 4. The pressure fluid acts through the closed tube system on all four side members of the tensioning frame 1. In any event, the frame member 2 is constructed such that two opposite tensioning bars 5 can be removed. In this case it is possible to clamp the stencil 9 on two sides. The tensioning frame 1 according to the invention is thus universally usable.

The tensioning frame 1 according to the invention is characterized furthermore by the fact that its basic design consists substantially of only two different aluminum profiles and thus it is inexpensive to manufacture.

The assembly of the tensioning frame 1 is also considerably facilitated in that the tensioning tubes 4 are connected to the nipples 22 and 27 of the corner piece 20 and connecting piece 21 before they are installed in the tensioning frame 1. When the tensioning tubes 4 are pre-installed in this manner, then the mounting pins 14 are introduced into the socket openings 23 of the corner pieces 20. It has been found that the configuration of the connecting pieces according to the invention and their arrangement in corner areas enables problem-free installation and arrangement of the tensioning tubes 4 in the tensioning frame 1.

Figure 7:
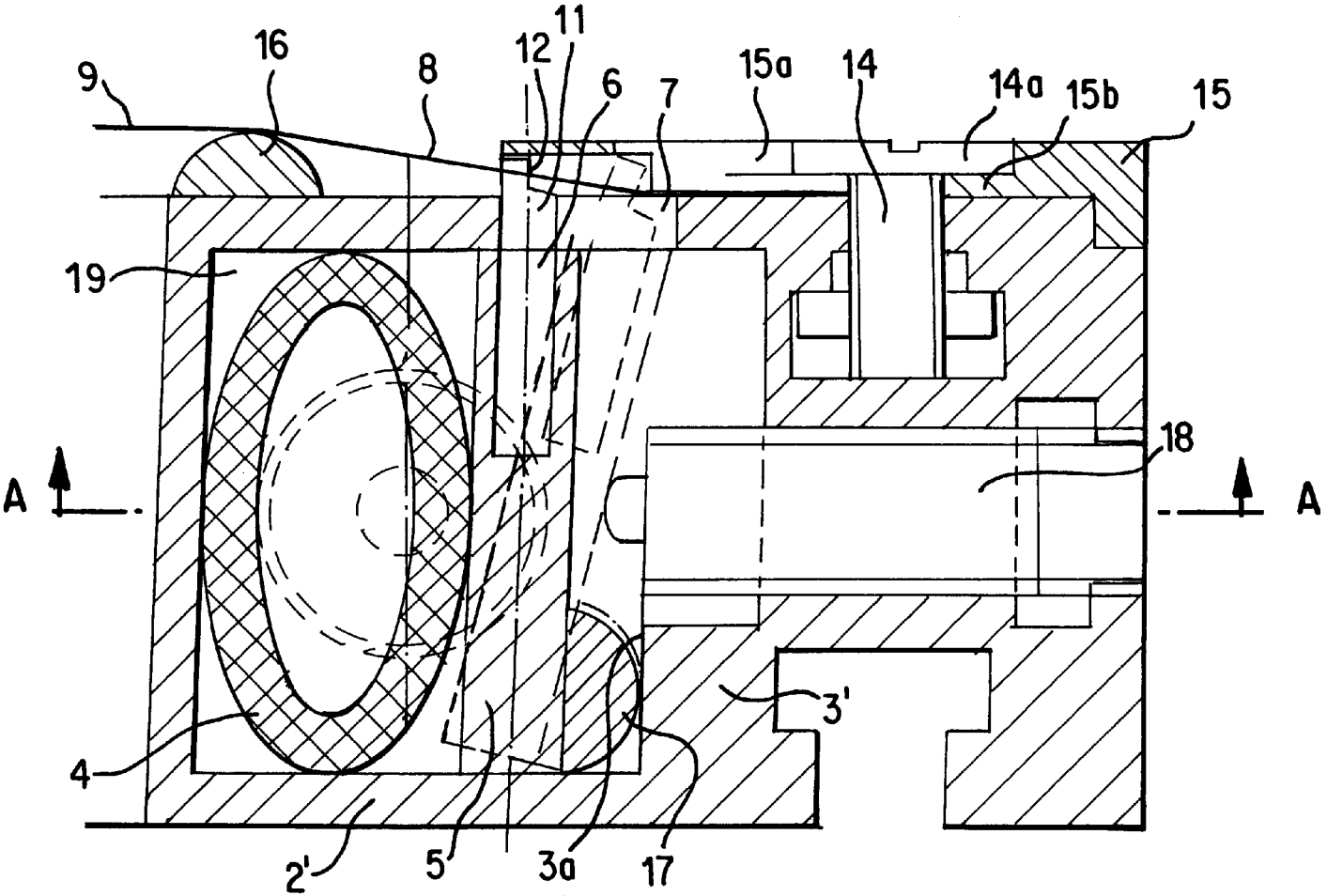
FIG. 7 shows a cross section corresponding to FIG. 2 of an alternate embodiment of the tensioning frame of the invention.

FIG. 7 is a sectional view of an alternate embodiment of the tensioning frame of the invention. Like FIG. 2, FIG. 7 depicts a section taken along line B—B of FIG. 1. For the most part the embodiment of FIG. 7 corresponds to the embodiment shown in FIG. 2, and like parts are identified by corresponding reference numerals. However, in the embodiment of FIG. 7, instead of the frame member 2 being closed by a separate closing profile 3 as in FIG. 2, the outward edge of the frame member 2' is closed by an integral closing member 3' which is formed in one piece therewith. In other respects, the structure and operation of the embodiment of FIG. 7 correspond to that of the embodiment of FIG. 2.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A tensioning frame for a metal foil or synthetic resin film having mounting perforations adjacent its margin, said tensioning frame comprising a frame member having a plurality of sides;

at least one tensioning bar extending along a respective side of said frame member, each of said at least one tensioning bar being pivotably mounted on its respective side of said frame member and carrying a plurality of holding pins which engage in mounting perforations of a foil or film to be tensioned;

a fulcrum strip that extends along an outward side of each of said at least one tensioning bar relative to the frame member, each of the at least one tensioning bar being pivotable against the fulcrum strip;

an elastically deformable inflatable tensioning tube disposed alongside each of said at least one tensioning bar adjacent an inward side thereof relative to said frame member; and a pressure fluid source in fluid communication with each tensioning tube;

each said tensioning tube being inflatable by said pressure fluid source to expand the tensioning tube against the adjacent at least one tensioning bar and pivot the at least one tensioning bar in an outward direction relative to said frame member, whereby a foil or film having its mounting perforations engaged on the holding pins of the at least one tensioning bar will be tensioned.

2. A tensioning frame according to claim 1, wherein a single pressure fluid source is in fluid communication with a plurality of elastically deformable inflatable tensioning tubes around the periphery of said frame member, whereby said plurality of elastically deformable inflatable tensioning tubes can be uniformly inflated.

3. A tensioning frame according to claim 1, wherein each at least one tensioning bar is in contact along its full length with an elastically deformable inflatable tensioning tube.

4. A tensioning frame according to claim 1, wherein, said fulcrum strip is supported against a closing profile of the frame member.

5. A tensioning frame according to claim 4, wherein the fulcrum strip is disposed off-center on the outward side of the at least one tensioning bar and extends along the entire length of the at least one tensioning bar, and the elastically deformable inflatable tensioning tube engages the inward side of the at least one tensioning bar substantially centrally.

6. A tensioning frame according to claim 1, wherein said metal foil or synthetic resin film is a stencil for stencil printing.

7. A tensioning frame according to claim 1, wherein a plurality of tensioning tubes are connected to one another through connecting pieces fixed in the frame member.

8. A tensioning frame according to claim 7, wherein said frame member is U-shaped and is closed by an inserted outer profile such that an internal free space is formed in which the at least one tensioning bar, tensioning tube and connecting pieces are disposed, said connecting pieces being disposed in corners of said frame member as corner connectors.

9. A tensioning frame according to claim 7, wherein the connecting pieces are provided with nipples inserted in ends of the tensioning tube and with a fluid passage extending between the nipples for communicating between successive tensioning tube, and one of said connecting pieces further comprises a pressure fluid source passage communicating with the fluid passage extending between the nipples.

10. A tensioning frame according to claim 7, wherein the connecting pieces are constructed in two parts, one of said parts being a corner connecting piece having a nipple on one side for insertion in an end of a first tensioning tube and a socket on an adjacent side, and the other of said pieces being a side connecting piece having a nipple on one side for insertion in an end of a second tensioning tube and a connecting pin on an opposite side, said connecting pin on said side connecting piece being matingly received in said socket on said corner connecting piece.

11. A tensioning frame according to claim 10, wherein the corner connecting piece has a passage leading from its nipple to the socket and the side connecting piece has a passage leading from its nipple through said connecting pin, such that the respective nipples are in fluid communication with each other when the connecting pin is received the socket, and wherein said connecting pin is sealed in said socket by at least one sealing ring.

12. A tensioning frame according to claim 1, wherein the a plurality of tensioning bars are arranged in pairs on opposite sides of the frame member.

13. A tensioning frame according to claim 1, wherein the holding pins of the at least one tensioning bar extend out from said frame member thorough openings in a wall of said frame member.

14. A tensioning frame according to claim 8, wherein adjusting screws are provided in said outer profile, said adjusting screws contacting the at least one tensioning bar to limit pivoting movement of the at least one tensioning bar.

15. A tensioning frame according to claim 1, wherein ends of the holding pins, which engage perforations of the foil or film to be tensioned, have a semicircular cross-sectional configuration with a flat face facing outwardly relative to said frame, and the perforations adjacent the margin of the foil or film to be tensioned correspond in shape and arrangement to the shape and arrangement of the holding pins on the at least one tensioning bar.

16. A tensioning frame according to claim 15, wherein the flat faces of the holding pins are slanted relative to a plane defined by the foil or film to be tensioned and form an undercut notch to hold the perforations of the foil or film to be tensioned on the holding pins.

17. A tensioning frame according to claim 1, further comprising alignment guide pins on said frame member which engage U-shaped notches formed in the margins of the foil or film to be tensioned to assure proper alignment of the foil or film on the tensioning frame.

18. A tensioning frame according to claim 1, further comprising at least one cover plate attached to the frame member, said cover plate extending over the margin of the foil or film to be tensioned and over the holding pins of the at least one tensioning bar.

19. A tensioning frame according to claim 18, further comprising alignment guide pins on said frame member which engage notches in the margins of the foil or film to be tensioned to assure proper alignment of the foil or film, wherein said alignment guide pins have enlarged heads and said cover plates are provided with slots through which the enlarged heads of said alignment pins can be received, said cover being attached to the frame member by sliding projecting portions of the cover under the enlarged heads of the alignment guide pins after the alignment guide pins have been received through the slots in the cover.

20. A tensioning frame according to claim 4, wherein said closing profile is formed integrally in one piece with said frame member.

* * * * *